United States Patent [19]

Lundberg

[11] Patent Number: 4,557,465

[45] Date of Patent: Dec. 10, 1985

[54] CABLE DRIVE MECHANISM

[75] Inventor: Gary W. Lundberg, Federal Way, Wash.

[73] Assignee: The Boeing Company, Seattle, Wash.

[21] Appl. No.: 591,170

[22] Filed: Mar. 19, 1984

[51] Int. Cl.[4] ..... B66D 1/12; B66D 1/22; B66D 1/26

[52] U.S. Cl. ..... 254/287; 254/288; 254/292; 254/332; 254/333; 254/344

[58] Field of Search ..... 254/284, 287, 288, 290, 254/297, 291, 292, 313, 332, 333, 335, 344, 902; 57/211; 474/263

[56] References Cited

U.S. PATENT DOCUMENTS

| | | | |
|---|---|---|---|
| 724,504 | 4/1903 | Rice | 254/287 X |
| 2,448,674 | 9/1948 | Lawler | 254/297 X |
| 2,625,373 | 1/1953 | Hunt | 254/333 |
| 3,118,635 | 1/1964 | Landsem | 254/333 X |
| 3,122,934 | 3/1964 | Fihe | 474/263 X |
| 3,227,420 | 1/1966 | Scott | 254/284 |
| 3,466,013 | 9/1969 | Smith | 254/288 X |
| 3,666,239 | 5/1972 | Koshihara | 254/287 |
| 3,717,325 | 2/1973 | Peterson | 254/333 X |
| 3,785,511 | 1/1974 | Bonnamy et al. | 254/277 X |
| 3,836,123 | 9/1974 | Bausenbach et al. | 254/333 X |
| 3,841,606 | 10/1974 | Declercq | 254/333 |
| 3,843,097 | 10/1974 | Noly | 254/297 |
| 3,949,969 | 4/1976 | Kaufer | 254/333 |
| 4,058,294 | 11/1977 | Dressler | 254/333 |
| 4,113,237 | 9/1978 | Derrwaldt | 254/333 X |
| 4,256,199 | 3/1981 | Sellards | 254/333 X |
| 4,294,429 | 10/1981 | Desplats | 254/333 X |
| 4,349,180 | 9/1982 | Charles et al. | 254/281 X |

FOREIGN PATENT DOCUMENTS

| | | | |
|---|---|---|---|
| 1519591 | 2/1968 | France | 254/287 |

*Primary Examiner*—John M. Jillions
*Assistant Examiner*—Joseph J. Hail, III
*Attorney, Agent, or Firm*—Schwartz, Jeffery, Schwaab, Mack, Blumenthal & Evans

[57] ABSTRACT

A cable drive mechanism wherein a cable member comprising a plurality of individual cables disposed in side by side relation to form a flat member is successively wrapped around at least one cable wheel in one rotational direction and around at least one tension wheel in an opposite rotational direction, the tension wheel being mounted on pivot arms and connected to drive motors such that rotation of the tension wheel induces an angular moment in the pivot arms to urge the tension wheel toward the cable wheel in order to provide gripping friction on the cable member between the cable wheel and the tension wheel sufficient to overcome the inertia of the cable during start-up.

20 Claims, 6 Drawing Figures

CABLE DRIVE MECHANISM

The United States Government has rights in this invention pursuant to Contract No. FO4704-82-C0038 awarded by the U.S. Air Force.

The present invention relates to a cable drive mechanism. More particularly, the present invention relates to a cable drive mechanism for moving a vehicle along a defined path.

BACKGROUND OF THE INVENTION

Capstan drives using steel wire rope or cables are well known devices. They provide excellent traction in many situations. Various capstan-type cable drive mechanisms have been devised, particularly for hoisting devices.

In some systems the cables pass around or between two or more rollers with tractive friction being provided by nip pressure between the rollers. Representative examples include devices disclosed in U.S. Pat. Nos. 3,227,420; 4,058,294; 4,113,237 and 4,294,429. Other hoist arrangements using multiple rollers are disclosed in U.S. Pat. Nos. 3,717,325 and 3,785,511.

Devices are also known in which a pinch roller mounted on a pivotable arm is used to hold the cable against the winding drum and/or to control the winding of the cable on the drum. Examples of such devices are disclosed in U.S. Pat. Nos. 2,625,373; 3,836,123 and 3,841,606.

However, conventional capstan drives are subject to a number of disadvantages. Typically, a very large drum is required, particularly where large loads must be moved or where loads must be moved through longer distances. Heavy loads require use of comparatively large diameter cable or wire rope, which in turn requires a large diameter capstan to avoid sharp bends which result in excessive bending stresses on the cable. Heavy loads also require a larger number of wraps around the capstan to provide the required friction to prevent slippage. On long pulls the cable "walks" sideways along the drum, thus requiring drums of substantial width.

If there are only a few wraps of cable, the cable may be permitted to side slip and the width of the drum may be reduced, but the pulling power is also reduced. Such side slipping arrangements increase the wear on the cable and also cannot be used where the need for a large pull strength requires a large number of wraps.

A problem is also encountered in starting up cable drive systems. Unless the cable is urged against the drum by tension or otherwise to provide adequate energizing friction between the cable and the drum, the drum may spin within the cable without drawing the cable in the desired direction.

Hydraulic cable pullers which operate by means of reciprocating grippers are also known. These devices are compact and very powerful, but because of their reciprocating motion, they are very slow and their operation is not especially smooth.

There remains a need for a cable drive mechanism which is not subject to the foregoing disadvantages.

SUMMARY OF THE INVENTION

Accordingly, it is an object of the present invention to provide a cable drive mechanism which is powerful yet compact.

Another object of the present invention is to provide a cable drive mechanism which avoids side slippage and excessive cable bending stress.

It is also an object of the present invention to provide a cable drive mechanism which operates quickly and smoothly.

A further object of the present invention is to provide a cable drive mechanism which is self energizing to provide the essential traction for starting up.

These and other objects of the invention are achieved by providing a cable drive mechanism comprising in combination a frame, a plurality of cable wheels and an idler wheel rotatably mounted on said frame, pivot means pivotally mounted on said frame, a tension wheel rotatably mounted on said pivot means such that said pivot means may be pivoted to move said tension wheel toward said idler wheel to form a nip therebetween, a cable member successively wrapped partially around each of said cable wheels and partially around said tension wheel, passing through the nip between said tension wheel and said idler wheel and being wrapped partially around said idler wheel in the rotational direction opposite the rotational direction in which it is wrapped around said tension wheel, and drive means for rotating said tension wheel in a rotational direction opposite the rotational direction in which said pivot means is pivoted to move said tension wheel toward said idler wheel, whereby rotation of said tension wheel induces an angular moment in said pivot means urging said tension wheel against said idler wheel to grip said cable means therebetween during start-up.

In another aspect of the invention the objects of the invention are achieved by providing a cable drive mechanism comprising in combination a vehicle to be moved along a defined path, a cable wheel rotatably secured to said vehicle with its axis oriented transversely with respect to a direction of intended movement of said vehicle along said defined path, a tension wheel mounted on pivot means and having its axis substantially parallel to the axis of the cable wheel, said pivot means being secured to said vehicle for pivotal movement about an axis parallel to the axis of said cable wheel so that said tension wheel can be pivoted toward said cable wheel to form a nip therebetween, means for urging said pivot means and said tension wheel toward said cable wheel, a cable member wrapped partially around said cable wheel in one rotational direction, extending through said nip between said cable wheel and said tension wheel and wrapped around said tension wheel in the opposite rotational direction, said cable member then extending on along said defined path and being anchored in the direction of intended movement of said vehicle, and means connected to said tension wheel for driving said tension wheel to draw said cable member around said tension wheel, through said nip and around said cable wheel thereby to pull said vehicle along said defined path.

In another aspect of the invention, the objects are achieved by providing a cable drive mechanism comprising in combination a first cable wheel, a first tension wheel, a second cable wheel and a second tension wheel oriented on parallel axes and disposed in a common plane, a cable member partially wrapped successively around each of said first cable wheel, said first tension wheel, said second tension wheel and said second cable wheel, said cable member being wrapped in one rotational direction around said cable wheels and in the other rotational direction around said tension wheels, means for adjusting the relative position of said first tension wheel with respect to said first cable wheel and for adjusting the relative position of said second tension wheel with respect to said second cable wheel in order to regulate the frictional grip between said cable member and said wheels, and means for driving at least one of said wheels to draw said cable through said mechanism.

BRIEF DESCRIPTION OF THE DRAWINGS

The invention will be explained in further detail with reference to the accompanying drawings wherein.

DETAILED DESCRIPTION OF PREFERRED EMBODIMENTS

Figure 1:
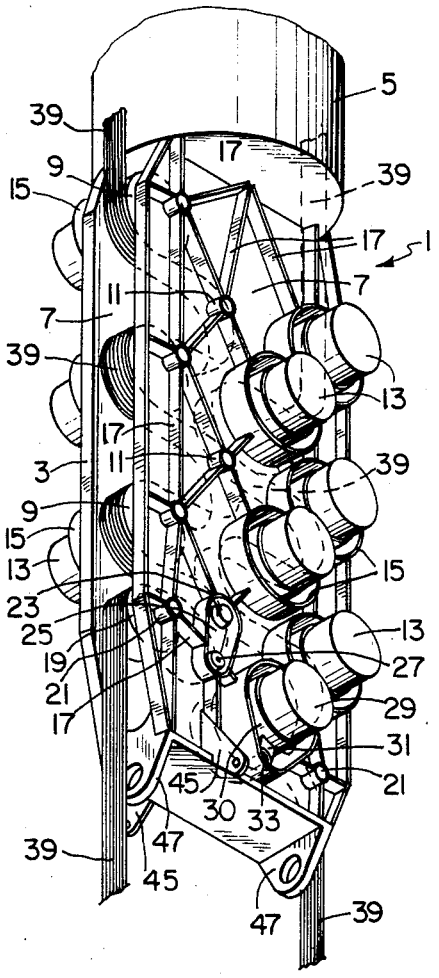
FIG. 1 is a perspective view of a cable drive mechanism according to the present invention.

FIG. 1 shows a perspective view of a cable drive mechanism for a rocket elevating or lifting device for a missile or rocket booster. The drive mechanism, generally designated by reference numeral 1, comprises a frame 3 attached to a supporting member 5 for a missile or rocket (not shown). Frame 3 comprises a pair of laterally spaced panels 7 having a series of aligned capstan drums or cable wheels 9 journally mounted between them on parallel axes in a staggered arrangement. In the illustrated device, two staggered series of cable wheels are provided, one on each side of the device. Apertured flanges 45 and 47 are provided on frame 3 for connecting the rocket and erector drive assembly to a transport vehicle (not shown) which transports the assembly to the point of erection.

Each cable wheel 9 is journally mounted on one end in a hub ring 11 secured to the outer surface of one of the panels 7. The other end of each cable wheel assembly is operatively connected to an electric drive motor 13 which is secured within a mounting ring 15 attached to the outer face of the other panel member 7. Structural reinforcing members 17 are welded between the hubs 11 and motor mounting rings 15 in order to provide increased structural strength and rigidity to the frame.

Figure 5:
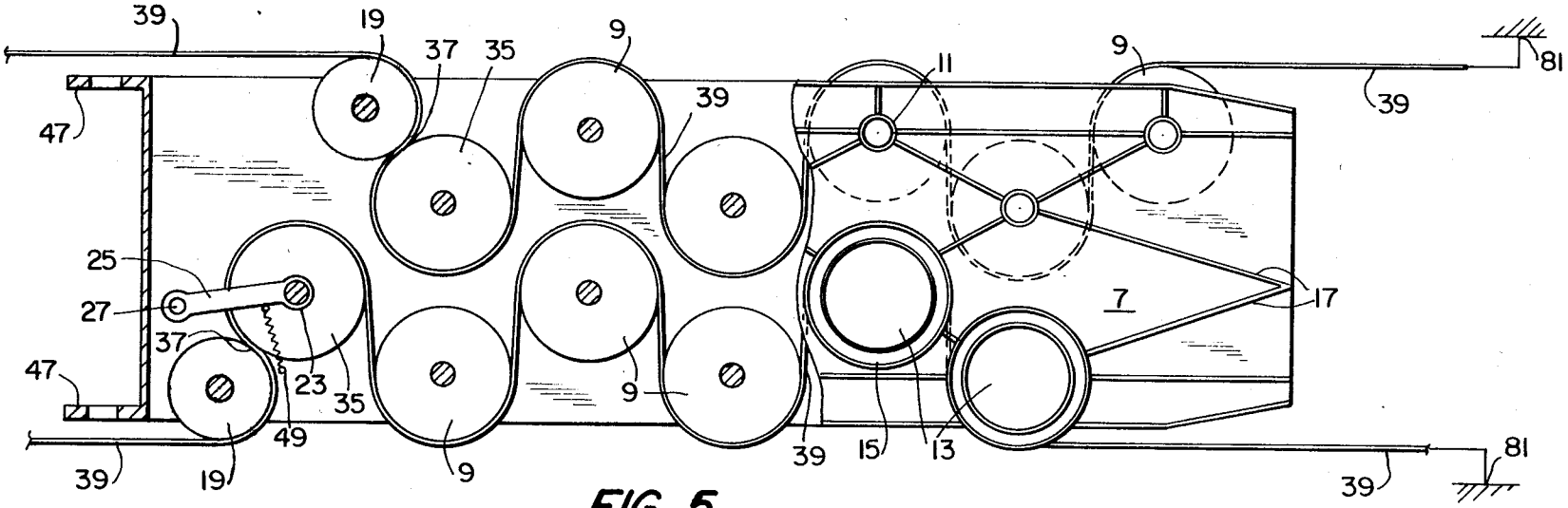
FIG. 5 is a schematic elevational view, partly in section, of the cable drive mechanism of FIG. 1.

At the end of each series of cable wheels there is provided an idler wheel 19 journally mounted in hub members 21 on plates 7. The cable wheel adjacent each idler wheel 19 is journally mounted at one end in a hub member 23 which in turn is mounted on the end of a pivot arm 25 pivotally attached to frame 7 at 27. The other end of the cable wheel adjacent each idler wheel is operatively connected to an electric motor 29 secured in a mounting ring 30 which in turn is connected to an arm 31 pivotally attached to panel 7 at 33. For convenience in description, such a pivotally mounted cable wheel will hereinafter be referred to as a tension wheel. As better seen in FIG. 5, the tension wheels identified by reference numeral 35 are pivotally mounted in such a way that they can be pivoted against the adjacent idler wheels 19 to form a nip 37 therebetween.

A cable member 39 is successively wrapped partially around each cable wheel, around the tension wheel and around the idler wheel of each set of drive wheels. As clearly seen in FIG. 5, each cable member passes around successive wheels in alternate rotational directions. Thus, in FIG. 5, the upper cable member 39 beginning from the righthand side of the figure passes in a counterclockwise direction around the first, third and fifth cable wheels 9 and the idler wheel 19 and in the clockwise rotational direction around the second and fourth cable wheels 9 and the tension wheel 35 of the upper wheel set. In like manner, the lower cable member beginning from the righthand side of the figure passes in a clockwise direction around the first, the third and fifth cable wheels 9 and the idler wheel 19 and in a counterclockwise rotational direction around the second and fourth cable wheels 9 and the tension wheel 35 of the lower wheel set.

Figure 3:
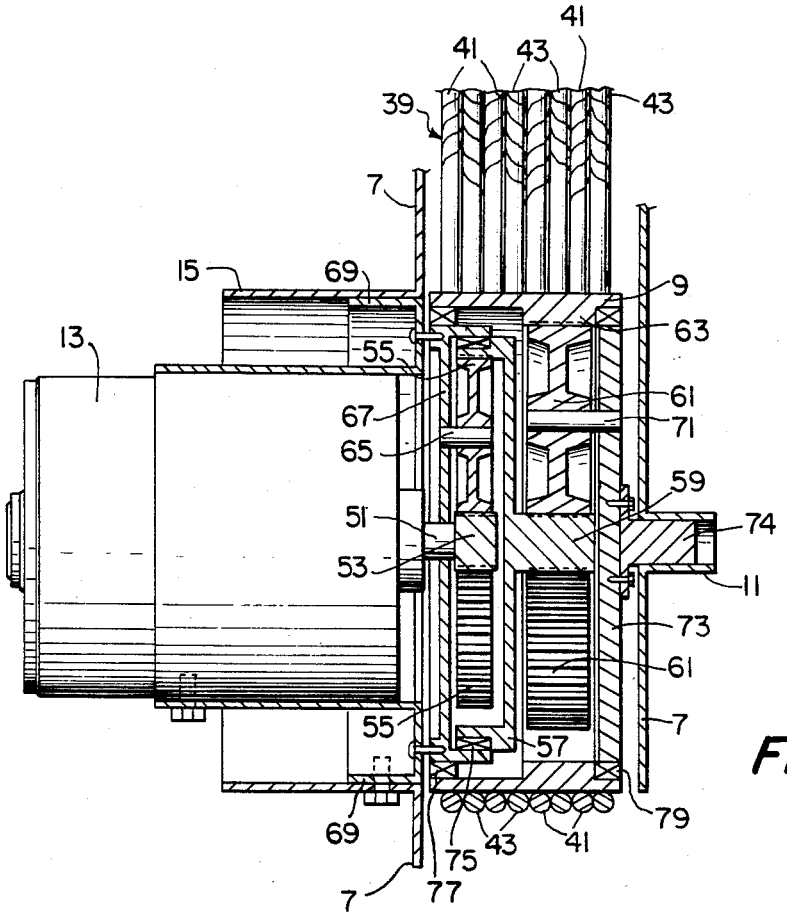
FIG. 3 is a sectional view through the motor and drive wheel arrangement of FIG. 2.
Figure 4:
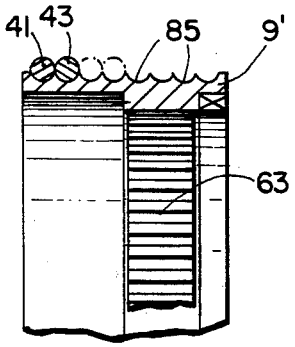
FIG. 4 is a partial sectional view of an alternate drive wheel configuration.

As more clearly seen in FIG. 3, cable member 39 comprises a plurality of individual cables 41 and 43 disposed in side by side relation. If desired, the cables may be interconnected to form a belt-like assembly. Desirably, in order to compensate for torsional forces which arise when a spirally wound cable is placed under tension, the cable member comprises an even number of individual cables and adjacent cables are wound in alternate directions. Accordingly, reference numeral 41 designates lefthand wound cables and reference numeral 43 designates righthand wound cables. In the illustrated embodiment, an eight strand cable member is utilized. In this way the torsional force arising when an individual cable is subjected to tension is compensated by an opposite torsional force from an adjacent cable.

Use of a plurality of small diameter cables produces a cable member having a tensile strength equivalent to a single cable of much larger diameter but which may be bent through a much smaller radius of curvature than a single large diameter cable of equivalent strength. This makes it possible to use smaller diameter cable wheels and reduce the overall size of the drive mechanism. Advantageously, the diameters of the cable wheels and the tension wheels may all be kept the same so that the bending of the cable member as it passes through the cable drive mechanism will be substantially uniform, thereby minimizing the adverse effects of bending stress.

Since the cable member is only wrapped partially around each of the wheels, it does not "walk" sideways as it is drawn through the wheels of the drive mechanism. Consequently, the axial length of the wheel members need only be as great as the width of the cable member. This also enables a reduction in the overall size of the cable drive mechanism.

Preferably, the cable member is wrapped only partially around each of the wheels through an arc ranging from about 90° to about 270°. In the device illustrated in FIGS. 1 through 5, the wrap angle around the first cable drive wheel is approximately 90°; around each of the second through fifth cable wheels the wrap angle is approximately 180° and around the tension wheels and idler wheels the wrap angle is approximately 225°. Use of individual wheel wrap angles of approximately 180° or less is considered desirable in that it reduces bending stress on the cable and promotes extended cable service life.

In the illustrated embodiment, the total wrap angle of each eight strand cable around the five cable wheels and the tension wheel of each drive wheel set amounts to approximately 1,035° or just under three complete wraps. The traction or drawing force may be computed according to the well known belt drive formula:

$$\frac{T_t}{T_s} = e^{\mu\Psi}$$

where $T_t$ equals the tight side tension, $T_s$ equals the slack side tension, e equals the base of natural logarithms, $\mu$ equals the coefficient of friction and $\psi$ equals the wrap angle in radians ($180° = \pi$ radians).

Means, such as tension spring 49, are also provided to bias the tension wheel and pivot assembly toward the adjacent idler wheel. Additional pulling force can be provided by increasing the number of cable drive wheels. In the illustrated device, all of the wheels except for the final idler wheels are driven, but it should be understood that fewer than all of the wheels may be provided with drive motors if desired. It is only necessary that the tension wheel be driven.

Figure 2:
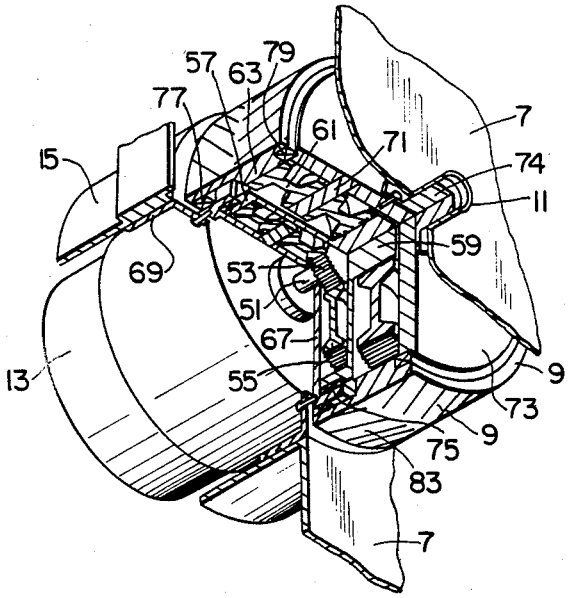
FIG. 2 is an enlarged perspective view of a motor and drive wheel arrangement from the drive mechanism of FIG. 1.

FIGS. 2 and 3 illustrate in greater detail how the cable wheels and tension wheels are driven by the electric motors. Each cable drive wheel 9 or tension wheel 35 is connected to the associated electric motor 13 via a two-stage planetary gear reduction drive which is disposed inside the wheel. A compact and highly efficient drive arrangement is thus achieved. Motor 13 turns a shaft 51 with a sun gear 53 at the end thereof. Sun gear 53 causes a set of planetary gears 55 to rotate. A ring member 57 is driven by the planetary gears 55 and transmits power to an integral sun gear 59 of the next planetary gear stage. Sun gear 59 rotates a second set of planetary gears 61 which in turn engage a set of internal teeth 63 on wheel 9 and cause the wheel to rotate. Planetary gears 55 are journaled on shafts 65 mounted on end plate 67 which is attached to plate 7 by brackets 69. Planetary gears 61 are journaled on shafts 71 mounted on end plate 73 which is attached to a shaft member 74 journaled in hub 11. Bearings 75, 77 and 79 are interposed between ring member 57 and a flange on end plate 67, between the outer periphery of end plate 67 and the inner surface of wheel 9 and between the outer periphery of end plate 73 and the inner surface of wheel 9, respectively, in order to permit rotation of the parts.

The drive arrangement for tension wheels 35 is essentially the same as that for cable wheels 9 except that motor mounting ring 15 is mounted on pivot arm 31 and shaft member 74 is journaled in hub 23 at the end of pivot arm 25 so that the tension wheel assembly can be pivoted with respect to the adjacent idler wheel 19 as previously described.

The ends of cable members 39 in the direction of intended movement are anchored as indicated schematically at 81. As shown in FIG. 2, the outer surface of each cable wheel 9 may be provided with a tread-like surface configuration. As seen in the partial sectional view of an alternate cable wheel 9' in FIG. 4, the outer circumference of the cable wheels may alternately be provided with annular grooves 85 which receive the individual cables 41 and 43.

In operation, the rocket and erector drive frame assembly is transported to the point of erection by a vehicle (not shown). The remote ends of cable members 39 are anchored at a point above the rocket. The proximate ends of cable members 39 are then threaded around the cable wheels, tension wheels and idler wheels as shown most clearly in FIG. 5. Since the cable members themselves may be somewhat difficult to handle, a leader may advantageously first be threaded through each wheel arrangement after which the proximate end of the cable member is attached to one end of the leader and then the cable drive mechanism is operated so that the leader draws the cable successively around the wheels of the set.

Tension wheel 35 is biased toward idler wheel 19 by tension spring 49 to assure contact between the interposed cable member and the wheels. The tension of the spring, however, may be inadequate to provide sufficient frictional contact between the tension wheel and the cable member to overcome the inertia of the cable member upon start-up. The drive mechanism of the invention nevertheless avoids startup problems by means of a unique self energizing action. The self energizing action arises from the specific arrangement of the cable member with respect to the tension wheel and the pivot arms on which the tension wheel is mounted. In particular, the cable member is wrapped around the tension wheel in a rotational direction opposite the rotational direction in which the pivot arms pivot in order to bring the tension wheel into contact with the idler wheel. As a result of this arrangement, the rotational movement of the tension wheel produces reaction forces which induce an angular torque or moment on the pivot arms which tends to urge the tension wheel more strongly toward the idler wheel. Accordingly, the rotation of the tension wheel produces an increased gripping force on the cable precisely at the time of start-up when it is most needed to overcome the inertia of the cable.

Once the cable is set in motion, the tension of the cable generally can be counted on to provide sufficient frictional contact between the cable drive wheels and the cable member to keep the cable member moving. The erector drive and rocket assembly is thus pulled upwardly as the cable members are drawn through the drive wheel sets.

Figure 6:
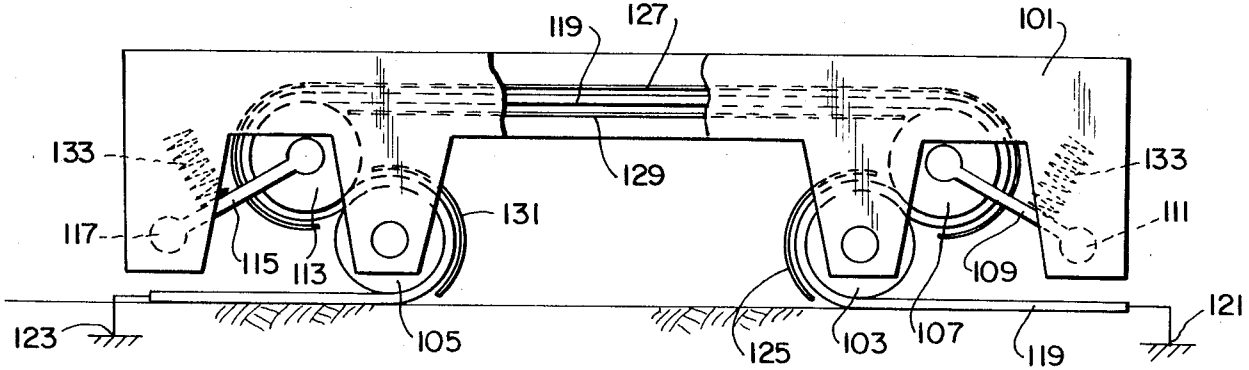
FIG. 6 is a schematic representation of another embodiment of cable drive mechanism according to the present invention.

FIG. 6 illustrates another embodiment of the invention which is particularly adapted to drive a vehicle such as a mine truck, which repeatedly moves back and forth along a fixed course.

In FIG. 6, a vehicle 101 is supported on a front cable wheel 103 which serves as a load wheel and a rear cable wheel 105 which serves as a load wheel. The vehicle is also provided with a front tension wheel 107 mounted adjacent front cable wheel 103 on the end of a pivot arm 109 which in turn is pivotally mounted on vehicle 101 at 111. Similarly, a rear tension wheel 113 is provided adjacent rear cable wheel 105 at the end of a rear pivot arm 115 which in turn is pivotally mounted on vehicle 101 at 117. As can be seen from FIG. 6, the respective axes of the front and rear tension wheels are spaced apart a greater distance than the axes of the front and rear cable wheels. This arrangement generally provides for a larger wrap angle around each of the wheels and a consequent increase in the frictional engagement between the cable member and the wheels. It is also possible within the scope of the invention, however, to use arrangements in which the tension wheels are more closely spaced than the cable wheels.

Compression springs 133 are provided on the vehicle to urge the pivot arms 109 and 115 and tension wheels 107 and 113 toward the associated cable wheels. A cable member 119, similar in construction to the flat belt cable member 39 of the device of FIGS. 1–5, is wrapped clockwise around the front cable wheel, counterclockwise around the front and rear tension wheels and then clockwise around the rear cable wheel. As in the case of the previous embodiment, the tension wheels and cable wheels may desirably be of the same size to provide for uniform bending of the cable member as it passes through the drive mechanism. The front end of cable member 119 is anchored as shown at 121. Similarly, the rear end of cable member 119 is anchored as shown at 123.

Shrouds 125, 127, 129 and 131 are provided along the path of the cable member in closely spaced relation thereto. These shrouds serve as threading guides as the cable is threaded through the drive wheel assembly.

Each of the tension wheels is driven by a reversible drive (not shown). Electric motor and planetary gear arrangements substantially like that used in the embodiment of the invention illustrated in FIGS. 1–5 could be used, for example.

In the illustrated embodiment, the cable member is wrapped partially around each of the cable wheels and tension wheels through an arc of approximately 225°. If desired this degree of wrapping may be varied from as little as about 90° to as much as about 270°. Generally, the heavier the cable, the smaller the degree of wrapping will be. When additional drawing power is required, instead of increasing the degree of wrapping around each wheel, additional drive wheels may simply be provided.

To move the truck in the forward direction, the drive for rear tension wheel 113 is energized to drive the wheel in the counterclockwise direction. Rotation of wheel 113 induces a clockwise angular moment on pivot arm 115 which urges the rear tension wheel against rear cable wheel 113 to securely grip cable member 119 between the wheels as the vehicle starts to move.

When it is desired to move the vehicle in the reverse direction, the drive for front tension wheel 107 is energized to turn the wheel in the clockwise direction. A similar self-energizing start-up action is obtained.

If desired, reversible drive means could be provided for each of the four wheels illustrated, and increased power may be obtained by driving two or three of the wheels. The rear load wheel in the direction of intended movement will ordinarily not be driven.

The cable drive mechanism of the invention is useful in elevators or lifting devices for heavy equipment such as erectors for rocket launchers. It also may be used to drive numerous other types of vehicles, particularly those which move over a fixed course, such as mine trucks, elevator cars, elevated trams, cable cars, crane carriages, dollies and the like. Because the motion of the drive mechanism is all rotary motion, as opposed to reciprocating motion, the operation of the drive mechanism is remarkably smooth.

The foregoing description has been set forth merely to illustrate preferred embodiments of the invention and is not intended to be limiting. Since modifications of the disclosed embodiments incorporating the spirit and substance of the invention may occur to persons skilled in the art, the scope of the invention is to be limited solely with respect to the appended claims and equivalents.

I claim:

1. A cable drive mechanism comprising in combination:

a frame;

a plurality of independently driven cable wheels and an idler wheel rotatably mounted on said frame;

pivot means pivotally mounted on said frame;

a tension wheel rotatably mounted on said pivot means such that said pivot means may be pivoted to move said tension wheel toward said idler wheel to form a nip therebetween;

a cable member successively wrapped partially around each of said cable wheels and partially around said tension wheel, said cable member further passing through the nip between said tension wheel and said idler wheel and being wrapped partially around said idler wheel in the rotational direction opposite the rotational direction in which it is wrapped around said tension wheel; and drive means for rotating said tension wheel in a rotational direction opposite the rotational direction in which said pivot means is pivoted to move said tension wheel toward said idler wheel, whereby rotation of said tension wheel induces an angular moment in said pivot means urging said tension wheel against said idler wheel to grip said cable member therebetween.

2. A cable drive mechanism according to claim 1 wherein said cable member comprises a plurality of parallel cables disposed in side by side relation to form a flat member.

3. A cable drive mechanism according to claim 2 wherein adjacent cables are wound in opposite directions.

4. A cable drive mechanism according to claim 1 further comprising means for resiliently urging said tension wheel on said pivot means toward said idler wheel.

5. A cable drive mechanism according to claim 1 further comprising means for anchoring an end of said cable member remote from said idler wheel.

6. A cable drive mechanism according to claim 1 wherein said drive means for rotating said tension wheel comprises an electric motor operatively connected to said tension wheel to rotate said tension wheel.

7. A cable drive mechanism according to claim 6 wherein said electric motor is operatively connected to said tension wheel by means of a planetary gear arrangement disposed inside said tension wheel.

8. A cable drive mechanism according to claim 1 wherein said plurality of cable wheels are arranged in a staggered relation, and said cable member is wrapped in alternate directions around successive cable wheels.

9. A cable drive mechanism according to claim 8 further comprising means for rotating each cable wheel.

10. A cable drive mechanism according to claim 9 wherein an individual electric motor is provided for each cable wheel to rotate each said cable wheel.

11. A cable drive mechanism according to claim 1 wherein said cable member is wrapped around each cable wheel through an arc lying in the range from about 90° to about 270°.

12. A cable drive mechanism according to claim 11 wherein said cable member is wrapped around the first cable wheel through an arc of about 90°, around each subsequent cable wheel through an arc of about 180°, and around each of said tension wheel and said idler wheel through an arc of about 225°.

13. A cable drive mechanism according to claim 1 wherein the outer circumference of said tension wheel is specially configured to grip said cable means.

14. A cable drive mechanism according to claim 1 comprising at least two cable members, each cable member being threaded through a set of drive wheels comprising a plurality of cable wheels, a pivotally mounted tension wheel and an idler wheel.

15. A cable drive mechanism comprising in combination:

a vehicle to be moved along a defined path;

a cable wheel having a first drive means and secured to said vehicle with its axis oriented transversely with respect to a direction of intended movement of said vehicle along said defined path;

a tension wheel mounted on pivot means and having its axis substantially parallel to the axis of said cable wheel, said pivot means being secured to said vehicle for pivotal movement about an axis parallel to the axis of said cable wheel so that said tension wheel can be pivoted toward said cable wheel to form a nip therebetween;

means for urging said pivot means and said tension wheel toward said cable wheel;

a cable member wrapped partially around said cable wheel in one rotational direction, extending through said nip between said cable wheel and said tension wheel and wrapped around said tension wheel in the opposite rotational direction, said cable member then extending on along said defined path and being anchored in the direction of intended movement of said vehicle; and a second drive means, independent from said first drive means, connected to said tension wheel for rotating said tension wheel to draw said cable member around said tension wheel, through said nip and around said cable wheel thereby to pull said vehicle along said defined path.

16. A cable drive mechanism according to claim 15 comprising a first cable wheel, a first tension wheel associated with said first cable wheel, a second cable wheel and a second tension wheel associated with said second cable wheel.

17. A cable drive mechanism according to claim 16 comprising individual drive means operatively connected to each tension wheel.

18. A cable drive mechanism according to claim 16 comprising an individual drive means for each of said tension wheels and for each of said cable wheels.

19. A cable drive mechanism according to claim 15 wherein said cable member comprises a plurality of parallel cables disposed in side by side relation to form a flat member.

20. A cable drive mechanism according to claim 15 wherein said cable member is wrapped around said drive wheel in a rotational direction opposite the direction in which said pivot means is pivoted to move said tension wheel toward said cable wheel whereby rotation of said tension wheel includes an angular moment in said pivot means urging said tension wheel toward said cable wheel to grip said cable means therebetween.

* * * * *